US005655665A

United States Patent [19]

Allen et al.

[11] Patent Number: 5,655,665

[45] Date of Patent: Aug. 12, 1997

[54] FULLY INTEGRATED MICROMACHINED MAGNETIC PARTICLE MANIPULATOR AND SEPARATOR

[75] Inventors: Mark G. Allen, Atlanta, Ga.; Chong-Hyuk Ahn, Cincinnati, Ohio

[73] Assignee: Georgia Tech Research Corporation, Atlanta, Ga.

[21] Appl. No.: 353,136

[22] Filed: Dec. 9, 1994

[51] Int. Cl.[6] ..... B03C 1/00

[52] U.S. Cl. ..... 209/223.1; 209/232

[58] Field of Search ..... 209/213, 223.1, 209/226, 227, 231, 232, 636; 210/222

[56] References Cited

U.S. PATENT DOCUMENTS

| | | | |
|---|---|---|---|
| 3,608,718 | 9/1971 | Aubrey, Jr. et al. | 209/223.1 X |
| 4,219,411 | 8/1980 | Yen et al. | 209/213 |
| 4,375,407 | 3/1983 | Kronick | 209/8 |
| 4,738,733 | 4/1988 | Muller-Ruchholtz et al. | 209/214 |
| 4,769,130 | 9/1988 | Christensen | 209/223.1 |
| 4,941,969 | 7/1990 | Schonert et al. | 209/232 X |
| 4,966,646 | 10/1990 | Zdeblick | 156/633 |
| 5,004,539 | 4/1991 | Colwell, Jr. | 209/232 X |
| 5,053,344 | 10/1991 | Zborowski et al. | 209/232 X |
| 5,123,901 | 6/1992 | Carew | 604/5 |
| 5,169,006 | 12/1992 | Stelzer | 209/232 X |

FOREIGN PATENT DOCUMENTS

| | | | |
|---|---|---|---|
| 1651965 | 5/1991 | U.S.S.R. | 209/232 |
| 2134819 | 8/1984 | United Kingdom | 209/232 |

OTHER PUBLICATIONS

I.W. Wolf, Electrodeposition of Magnetic Materials, Mar. 1962.

Henstock, M.E. and E.S. Spencer–Timms, The Composition of Thin Electrodeposited Alloy Films with Special Reference to Nickel–Iron, Jul. 9, 1963.

Sobek, Daniel, Albert M. Young, Martha L. Gray, and Stephen D. Senturia, A Microfabricated Flow Chamber for Optical Measurements in Fluids, Feb. 1993.

Ahn, Chong H., Yong J. Kim, and Mark G. Allen, A Planar Variable Reluctance Magnetic Micromotor With Fully Integrated Stator And Wrapped Coils, Feb. 7–10, 1993.

Ahn, Chong H., and Mark G. Allen, A Fully Integrated Surface Micromachined Magnetic Microactuator with a Multilevel Meander Magnetic Core, Mar. 1993.

*Primary Examiner*—William E. Terrell
*Assistant Examiner*—Tuan Nguyen
*Attorney, Agent, or Firm*—Deveau, Colton & Marquis

[57] ABSTRACT

A fully integrated micromachined magnetic particle manipulator and separator which can be used to influence magnetic particles suspended in a fluid. The magnetic particle manipulator and separator is integrated on a substrate, preferably a silicon wafer. The magnetic particle manipulator and separator is comprised of a fluid flow channel and integrated inductive components formed on each side of the channel. Each inductive component is comprised of a magnetic core and a conductor coil. Preferably, a meander-type inductor is used. The magnetic cores have ends located adjacent the fluid channel which function as electromagnet poles. When approximately 500 mA of DC current at less than 1 volt is supplied to the circuit, the inductive components produce magnetic fields and the magnetic particles suspended in the fluid clump onto the electromagnet poles. When the current is removed, the magnetic particles are released from the electromagnet poles.

18 Claims, 5 Drawing Sheets

TABLE I

COMPOSITION OF THE NICKLE-IRON AND COPPER ELECTROPLATING SOLUTIONS

| Nickel-Iron Permalloy | | Copper | |
|---|---|---|---|
| Component | Quantity (g/l) | Component | Quantity |
| $NiSO_4 \cdot 6H_2O$ | 200 | $CuSO_4 \cdot 5H_2O$ | 1200 (g/l) |
| $FeSO_4 \cdot 7H_2O$ | 8 | $H_2SO_4$ | 100 (ml/l) |
| $NiCl_2 \cdot 6H_2O$ | 5 | | |
| $H_3BO_3$ | 25 | | |
| Saccharin | 3 | | |

FULLY INTEGRATED MICROMACHINED MAGNETIC PARTICLE MANIPULATOR AND SEPARATOR

BACKGROUND OF THE INVENTION

The present invention relates to a magnetic particle manipulator and separator, and more particularly, to a magnetic particle manipulator and separator which is fully integrated on a silicon wafer. The magnetic particle manipulator and separator is comprised of a plurality of integrated inductive components which are located on both sides of a fluid channel formed in the integrated circuit. In operation, the inductive components generate magnetic fields which cause magnetic particles suspended in a fluid passing through the fluid channel to be separated from the fluid.

Prior to the present invention, macro-scale magnetic particle separators have been realized using permanent magnets. One such conventional magnetic particle separator utilizes an array of arbitrarily positioned, rectangular, rare-earth permanent magnets. Generally, in order to achieve a magnetic field gradient which is sufficient to separate the particles, quadrupole or multipole permanent magnet arrangements are adopted and ferromagnetic wires are also introduced to generate the required magnetic gradient in an otherwise uniform magnetic field. When the magnetic particles suspended in a solution are subjected to the field, the magnetic forces produced by the magnets cause the particles to migrate and coalesce on to the magnetic poles or the ferromagnetic wires.

Another type of conventional magnetic particle separator comprises a microtiter well for holding a buffer solution. Permanent magnets of opposite polarity are located within the well opposite each other. A fluid suspension with a specific ferrofluid reagent is pipetted into the microtiter well. A T-shaped frame holds removable ferromagnetic wires which are in contact with the solution. Cells specifically labeled with the ferrofluid reagents or magnetic particles are pulled onto the wires and, thus, are immobilized. The microtiter well is then lowered and subsequent wash steps can be performed on the immobilized cells (which are still in the magnetic field) using fresh buffer.

Generally, these conventional separators require hybrid-type components such as T-shaped loop holders, wires, permanent magnets, and yoke frames to construct the separators, which consequently increases the cost of the device. In addition, these separators usually involve somewhat complicated as well as time consuming separation steps. The present invention provides an integrated micromachined particle manipulator and separator which can be produced at a lower cost than conventional separators and which provides relative ease of handling. Since the magnetic particle manipulator and separator of the present invention is comprised as an integrated circuit, it is amenable to mass production. Other advantages of the present invention are, for example, design flexibility, compactness, and electrical control. Generally, the areas of the present invention include biological cell fractionation, enzyme immobilization, magnetic affinity chromatography, immunoassay, and extraction of impurities by absorption of materials onto magnetic particles.

The following patents disclose various type of prior art magnetic particle separators. Zborowski et al., U.S. Pat. No. 5,053,344, discloses a magnetic field separation system having a flow chamber comprised of first and second optically transparent slides mounted so as to define a generally planar fluid pathway. The flow chamber is oriented to promote fluid flow therethrough by a combination of gravitational and capillary action. Permanent magnets constitute a magnet means for separating sensitized particles in a biological fluid.

Carew, U.S. Pat. No. 5,123,901, discloses a method for removing or separating pathogenic or toxic agents from body fluids in which the pathogenic or toxic agent is flowed into a mixing coil along with a plurality of paramagnetic beads for marking the pathogenic agent. The mixture is then passed through a magnetic separator having a separation chamber. The separator is provided with a graded magnetic field along the length of the separation chamber. The magnetic field causes the paramagnetic beads with bound pathogenic agent to adhere magnetically to the wall of the separator.

Aubry, Jr., et al., U.S. Pat. No. 3,608,718, discloses a magnetic separator method and apparatus. The apparatus consists of a tubular element having a first baffle which divides the tube inlet into a feed inlet for receiving fluidized material and a surrounding coaxial passage for receiving wash fluid, and a second baffle spaced downstream from the first baffle for dividing the tube outlet into a tailings discharge passage and a surrounding coaxial concentrate discharge passage. Magnetic and magnetizable particles are attracted outwardly between the baffles by way of a radial magnetic field applied in the tube from a source surrounding the tube.

Christensen, U.S. Pat. No. 4,769,130, discloses a high-gradient magnetic separator for filtering weekly-magnetic particles from a fluid in which they are suspended. The fluid is caused to flow through a separation chamber arranged in a gap formed between a pair of opposed poled surfaces of a pair of separate permanent magnetic devices connected with a closed magnetic circuit which includes yoke members. The separator is designed as a large scale high-intensity and high-gradient separator for industrial applications operating without external power supply. Other examples of magnetic particle separators are disclosed in Müller-Ruchholtz et al., U.S. Pat. No. 4,738,773, Kronick, U.S. Pat. No. 4,375,407, and Yen et al., U.S. Pat. No. 4,219,411.

It is apparent that none of the foregoing patents propose an integrated particle separator. The present invention provides a fully integrated magnetic particle manipulator and separator which is fabricated on a silicon wafer and which includes integrated inductive components for generating the required magnetic fields. In the past, inductors generally were not used in integrated circuits due to the inability to achieve high enough inductor values to be useful in circuit design. Integrated circuit inductors have been used effectively in microwave circuits which operate at frequencies in the GHz range. For example, spiral inductors have been used in GaAs integrated circuits developed for receiving direct-broadcast satellite television signals. More recently, planar inductors have been implemented on chips which have applications in filters, sensors, AC/DC converters, and magnetic microactuators. Such structures have been fabricated using multilevel metal schemes to "wrap" a wire around a magnetic core or air core, but they tend to have relatively high resistance due to the fact that two interconnect vias per turn are required to realize the device.

In accordance with the present invention, the roles of the conductor wire and magnetic core in conventional inductors have been interchanged and the effect produced by the conventional inductors has been achieved by using a multilevel magnetic core which is "wrapped" around a planar conductor. This structure has the advantage that a relatively short, planar conductor is used, thus reducing total conductor resistance. In addition, this geometry has at least two advantages over the planar spiral-type geometry. First, the length of the conductor wire necessary to achieve the same number of turns is shorter than that of spiral conductors, which results in smaller conductor series resistance. Second, since the magnetic cores are tightly linked with the conductor coils, the leakage flux is relatively low, resulting in relatively high inductance. This meander-type integrated inductor and all of the other components of the magnetic particle separator have been fully integrated on a silicon wafer, as described in detail below.

SUMMARY OF THE INVENTION

In accordance with the present invention, a fully integrated micromachined magnetic particle manipulator and separator is provided on a silicon wafer. The magnetic particle manipulator and separator comprises meander-type integrated inductive components located on each side of a fluid channel. Each integrated inductive component comprises a multilevel magnetic core which is "wrapped" around a planar conductor. The conductors are electrically coupled to bonding pads to allow a DC (direct current) voltage to be applied to the inductors. The ends of the magnetic cores which are located adjacent the fluid channel function as electromagnet poles and by using two inductive components which are placed at both sides of the channel, an electromagnet quadrupole results. By having two inductor cores disposed on each side of the channel, two combinations of quadrupoles can be produced flexibly by switching DC excitation polarities at the coils. In order to achieve a high magnetic field gradient at the tip of the poles, magnetic flux leakages should be prevented between the cores. For this purpose, a magnetic shield layer shields the magnetic cores to reduce flux leakage while maximizing the flux at the poles.

One potential application of this device is magnetic particle separation of magnetic particles suspended in liquid solutions. When 500 mA of current with a DC voltage of less than 1 volt is applied to each inductor, very fast particle separation is observed and the magnetic particles clump onto the electromagnet poles. The magnetic particles clumped on the surface of the electromagnet poles can be released and resuspended easily by removing the applied current. The device can be repeatedly used for different separations after washing using acetone-based and methanol-based cleaning steps. Although DC excitation has been used to illustrate the separator operation, other modes of operation involving time-varying excitation may also be used, such as alternating current or a pulse of specific duration.

Accordingly, it is an object of the present invention to provide a micromachined magnetic particle manipulator and separator which is fully integrated on a silicon wafer.

It is also an object of the present invention to provide a magnetic particle manipulator and separator which is capable of manipulating small amounts of reagent.

It is yet another object of the present invention to provide a magnetic particle manipulator and separator which is amenable to mass production due to its integration feasibility.

It is yet another object of the present invention to provide a magnetic particle manipulator and separator which can be produced at a low cost relative to conventional magnetic particle manipulators and separators.

It is yet another object of the present invention to provide a magnetic particle manipulator and separator which is flexible in design.

It is yet another object of the present invention to provide a magnetic particle manipulator and separator which is compact in size and which can be electrically controlled.

It is yet another object of the present invention to provide a magnetic particle manipulator and separator which reduces the number of separation process steps which have been required in the past to separate magnetic particles suspended in a solution.

These and other objects of the present invention will become apparent from the foregoing detailed description of the invention and claims.

DETAILED DESCRIPTION OF THE INVENTION

There are generally two types of magnetic separations. First, the material to be separated is intrinsically magnetic, which is generally used for biological particles such as red blood cells or magnetic bacteria. Second, by the attachment of a magnetically responsive entity, one or more components to be separated have been rendered magnetic. This latter technique is useful for otherwise nonmagnetic chemical and biological systems. In such systems, magnetic separations generally are performed through conferring magnetism upon a nonmagnetic molecule (e.g., the molecule is absorbed or attached to a magnetically responsive particle). The magnetic particles used in the separation are normally very small ferromagnetic materials (0.1–1.3 micrometers in diameter) These particles are small enough that they may be unable to support magnetic domains. Such particles are classed as superparamagnetic materials which have high magnetic susceptibilities and saturation magnetization, but very weak magnetic hysteresis. Such particles become magnet dipoles when placed in a magnetic field, but lose their magnetism when the field is turned off. Hence, individual particles can be readily removed or resuspended after exposure in a magnetic field since no permanent magnetic dipoles can be sustained in the particles. The force on a particle which can be generated magnetically is described as $$F_x = V X_v \vec{H} \frac{\partial \vec{H}}{\partial x}; \qquad \text{Equation (1)}$$

where $F_x$ is the force on the particle in direction x, V is the volume of the particle, $X_v$ is its magnetic susceptibility per unit volume, H is the strength of the magnetic field, and the $$\frac{\partial \vec{H}}{\partial x};$$

is the magnetic field gradient. In Equation 1, the shape of the particle is assumed to be spherical and interactions between magnetic particles are not considered. As indicated in Equation 1, the force on a particle is proportional to V, $X_v$, H, and $$\frac{\partial \vec{H}}{\partial x};$$

In order to achieve a high attraction force on the particles, H and $$\frac{\partial \vec{H}}{\partial x};$$

are controllable parameters by optimizing the geometry of the separator in design.

Figure 1:
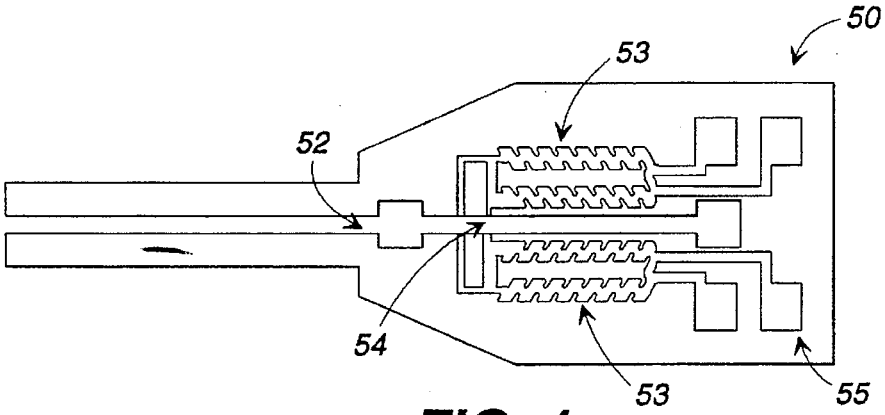
FIG. 1 illustrates a schematic diagram of the integrated micromachined magnetic particle manipulator and separator of the present invention.

FIG. 1 illustrates the fully integrated micromachined magnetic particle manipulator and separator 50 of the present invention. The magnetic particle separator 50 comprises a fluid channel 52 and two meander-type integrated inductive components 53 located on each side of the fluid channel 52. However, it is also possible to vary the number of inductive components as well as the locations of the inductive components while still achieving the objectives of the present invention. The design illustrated in FIG. 1 and discussed in detail below is simply the preferred embodiment. In accordance with the preferred embodiment, the ends 54 of the magnetic cores of the inductive components are disposed adjacent to the fluid channel 52. The conductors of the inductive components are electrically coupled to bonding pads 55 which, in operation, receive a DC voltage which results in an electric current being supplied to the conductors of the inductive component. During operation, suspended magnetic particles (not shown) are subjected to the magnetic field generated by the inductive components 53 and field gradients generated from the component pole geometries and thus are forced to move from the suspension to the surface of the electromagnet poles 54 while the magnetic field is on, in accordance with Equation 1 above. The collected particles on the surface of the poles 54 can be released by removing the current being applied to the inductive components.

As indicated in Equation 1, the magnetic field strength H and the magnetic field gradient $$\frac{\partial \vec{H}}{\partial x};$$

are the only controllable factors in designing the separator to achieve a high force on the particles. From both factors, the achievable magnetic field strength H depends on the performance of the inductive component which is limited by the allowable size and planar fabrication processes. In accordance with a preferred embodiment, the magnetic particle separator of the present invention is designed to be implemented in an area of 2 mm×3 mm. The achievable magnetic field strength is also strongly affected by the width of the flow channel, which is analogous to an air gap in magnetic circuits. With respect to the reluctance in the magnetic circuit, a narrower width of the channel is preferred, but it should have an appropriate width since the flow rate of a viscous magnetic fluid will be limited as the channel width is reduced. Thus, in accordance with the preferred embodiment of the present invention, the width of the flow channel is designed to be 100 μm, which allows an appropriate flow rate for the magnetic fluid to be used while a magnetic flux density of 0.03 Tesla can be achieved in the air gap by flowing 500 mA of DC current through the coil conductors.

Figure 2A:
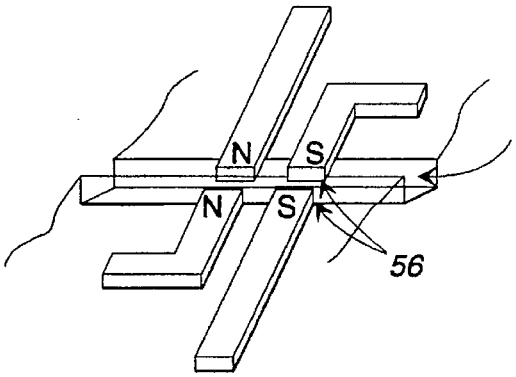
FIG. 2*a* illustrates a schematic diagram of the quadrupole produced at the fluid channel by the ends of the magnetic cores of the integrated inductive components wherein the DC excitation in the coils is producing an N-N-S-S pole combination.
Figure 2B:
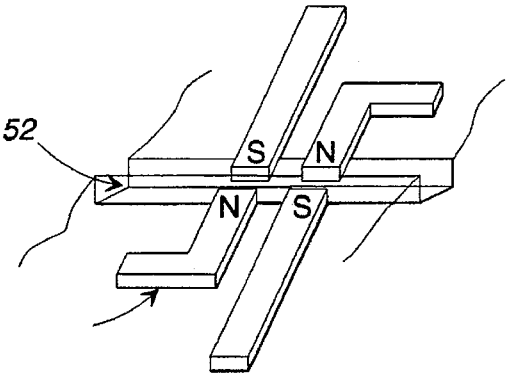
FIG. 2*b* illustrates a schematic diagram of the quadrupole produced at the fluid channel by the ends of the magnetic cores of the integrated inductive components wherein the DC excitation in the coils is producing an N-S-N-S pole combination.

In contrast to the conventional separators, the magnetic core of the present invention has the shape of a bar and the electromagnet poles located at the end of the core adjacent the fluid flow channel are almost similar to the tip of a needle in shape. Thus, a high magnetic field gradient will be generated at the tips of the poles 56. In order to achieve a high magnetic field gradient in the air gap, appropriate positioning and allocation of the poles is a dominant design consideration due to the small pole geometry. FIG. 2*a* illustrates a schematic diagram depicting one of two of the quadrupoles, an N-N-S-S pole combination, capable of being generated by providing DC excitation in the coils. The electromagnet quadrupole is adopted using two inductive components which are placed at both side of the channel 52, and thus, two combinations of quadrupoles can be produced flexibly by switching DC excitation polarities at the coils. FIG. 2*b* shows the second quadrupole, an N-S-N-S pole combination, generated by switching the DC excitation polarity of the current provided to the coils in FIG. 2*a*.

Figure 3:
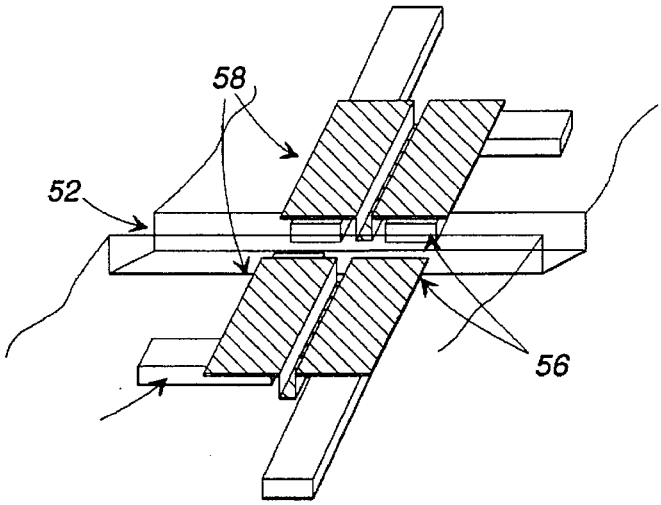
FIG. 3 illustrates a schematic diagram of the quadrupole formed by the ends of the magnetic cores of the integrated inductive components wherein the magnetic cores are covered with a magnetic shield layer.

In order to achieve a high magnetic field gradient at the tip of the poles, magnetic flux leakages should be prevented between the cores which are placed in proximity to each other, to insure that as much of the flux as possible is concentrated at the tip of the poles. FIG. 3 illustrates a schematic diagram of the quadrupole wherein a magnetic shield layer 58 prevents magnetic flux leakages between the cores located adjacent each other. The process for fabricating the magnetic particle separator and manipulator, which includes putting down the magnetic shield layer, will be discussed in detail below with respect to FIGS. 5*a*–6*b*.

Figure 4A:
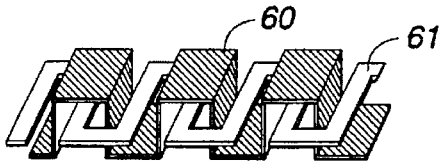
FIG. 4*a* illustrates a schematic diagram of the meander-type integrated inductor of the present invention.
Figure 4B:
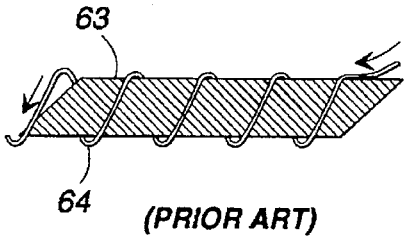
(PRIOR ART) FIG. 4b
FIG. 4*b* illustrates a schematic diagram of a conventional solenoid-bar type inductor.

FIG. 4*a* illustrates a schematic diagram of the meander-type integrated inductor of the present invention. FIG. 4*b* illustrates a schematic diagram of a conventional solenoid-bar type inductor. In the conventional solenoid-bar type inductors, the conductor lines 64 are wrapped around the magnetic core 63 to form an inductive component. Such structures can be realized as micromachined integrated components by using multilevel metal interconnect schemes to wrap conductor lines around magnetic materials. However, two problems arise from the solenoid-bar type inductor in actual planar fabrication. First, electrical via contacts are used to connect the wrapped coils (i.e., the conductor lines) from layer to layer, which increases the total conductor resistance due to the via contact resistance. Second, the total length of the coil is relatively long due to leaving adequate space for the multilevel coil interconnection vias, which also increases the total conductor resistance. Due to the extremely small cross section of conductor lines in any integrated inductor, the conductor line has a high electrical resistance even though it has a very short length. Thus, the reduction of this resistance while keeping the inductance relatively large is of extreme importance.

In accordance with the present invention, an integrated inductor can be realized by switching the roles of conductor and core as shown in FIG. 4*a* by "wrapping" the magnetic core 60 around a planar meander conductor line 61. This geometry is realized by using multilevel metal interconnect schemes to interweave a meander planar conductor 61 with a multilevel meander magnetic core 60, as schematically illustrated in FIG. 4*a*. This meander geometry has two advantages over the solenoid-bar type geometry: no electrical vias that add resistance to the conductor line since the planar meander conductor line is located on the planar surface without containing any electrical via contacts; and increased fabrication simplicity. However, it should be noted that it is also possible to use planar inductors which have the conductor lines "wrapped" around the magnetic core using the multilevel metal interconnect scheme mentioned above or a similar process. It is merely a preferred embodiment of the present invention to utilize the meander-type inductor having the magnetic core "wrapped" around a planar meander conductor.

Figure 5A:
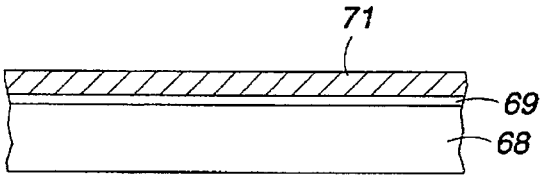
FIGS. 5*a*–5*e* illustrate the fabrication process used to fabricate the micromachined integrated particle manipulator and separator on a silicon wafer.
Figure 5B:
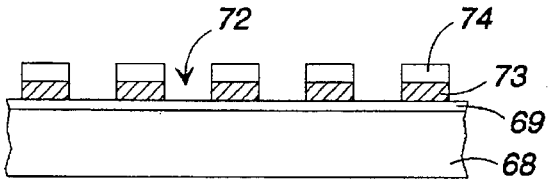

The process for fabricating the magnetic particle manipulator and separator of the present invention on a silicon wafer will now be described with respect to FIGS. 5*a*–6*b*. It should be noted that the parameters and materials discussed with respect to this process merely relate to the preferred embodiment and that the present invention is not limited to these parameters, materials or process steps. FIGS. 5*a*–6*b* depict cross-sectional side views of a silicon wafer having the integrated magnetic particle manipulator and separator fabricated thereon. As shown in FIG. 5*a*, the process starts with a 2-inch <100> silicon wafer 68 as a substrate. Onto this substrate, 0.3 μm PECVD silicon nitride is deposited (not shown). On top of this, titanium (1000 Å)/copper (2000 Å)/chromium (700 Å) layers 69 were deposited using electron-beam evaporation to form both a seed layer for electroplating and a bottom layer for the flow channel. Polyimide 71, preferably DuPont PI-2611 is then spin coated onto the wafer in order to build electroplating molds for the bottom magnetic core, discussed in more detail below. Preferably, four coats of polyimide are put down to obtain a thick polyimide film. Each coat is preferably cast at 3000 rpm, and soft baked for 10 minutes at 120° C. before the application of the next coat. After deposition of all the polyimide coats, the polyimide is cured at 300° C. for 1 hour in nitrogen, yielding an after-cure thickness of 40 micrometers. The next step, discussed with respect to FIG. 5*b*, is an etching step which creates holes in the polyimide which function as electroplating molds for the lower magnetic core. The holes 72 are etched in the polyimide using a 100% $O_2$ plasma etch and an aluminum hard mask 74 until the titanium/copper/chrome seed layer 69 has been exposed, as shown in FIG. 5*b*. The electroplating molds were then filled with nickel (81%)-iron (19%) permalloy using standard electroplating techniques and the nickel-iron electroplating bath described in Table I.

Figure 5C:
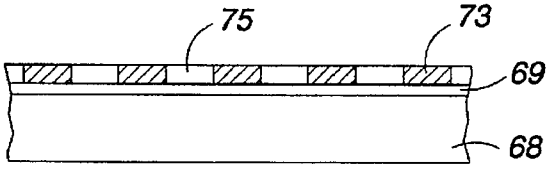
Figure 5D:
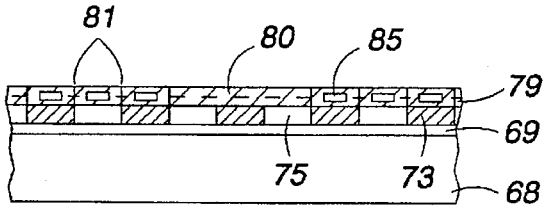

In order to electroplate the bottom magnetic cores, the topmost chromium layer is removed from seed layers 69 in the regions of holes 72, and electrical contact is made to the seed layer 69 and the wafer is immersed in the plating solution (not shown). During the electroplating, the solution is maintained at room temperature and a pH of approximately 2.7 and the solution is stirred very slowly with a Teflon® propeller blade. An applied current density of 5 mA per square centimeter results in an electroplating rate of 0.3–0.4 μm per minute. FIG. 5*c* illustrates the wafer once the bottom magnetic cores 75 have been electroplated thereon.

In order to create the magnetic shield layer around the quadrupole region as shown in FIG. 3, a trench (not shown) is etched around the quadrupole region using the dry-etch process described above with respect to FIG. 5*b*. Once the trench has been created, a DC-sputtered titanium (500 Å) layer (not shown) is deposited and patterned over the region which requires the magnetic shield. Polyimide layer 79 is then spin-coated (as above) and hard-cured at 300° C. for 1 hour, which insulates the bottom magnetic core 75 and shield layer (shown in FIG. 3) from the conductor coil put down in the next sequence of steps.

To construct a thick planar meander conductor coil, copper 85 is plated on a chromium (500 Å)/copper (2000 Å)/chromium (700 Å) seed layer (not shown) through a thick photoresist mold (not shown) comprised of a 70 μm wide copper plating mold formed in 8 μm thick photoresist. The copper conductors 85 were plated through the defined molds using standard electroplating techniques. Upon completion of the electroplating, the photoresist is removed with acetone and the copper seed layer is etched in a sulfuric-acid-based copper etching solution.

In an alternative embodiment, an aluminum conductor can be used instead of a copper conductor. When an aluminum conductor is chosen, 7 μm of aluminum is DC sputtered onto the polyimide layer 79 and patterned using conventional lithography and phosphoric-acetic-nitric (PAN) aluminum etching solution. When the plated copper conductor described above is used, the holes in the photoresist which function as the copper plating mold are formed by masking and exposing certain areas of the photoresist to ultraviolet light through a mask and developing the photoresist to remove the exposed areas. It should be noted that the bottom magnetic core 75 is electrically isolated from the plating solution during this step. After completion of the electroplating, the photoresist is removed with acetone and the copper seed layer is etched in an HCl-based copper etching solution.

Figure 5E:
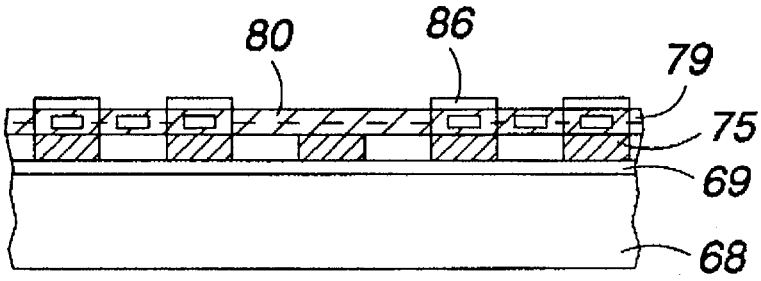

To insulate the conductor line 85 and re-planarize the surface, one coat of polyimide 80 approximately 10 μm in thickness is deposited in the same manner as described above. Via holes (not shown) are then dry-etched through the polyimide layer between the meander conductor 85 using 100% oxygen plasma and an aluminum hard mask (not shown). Upon completion of the via etch, the aluminum hard mask is removed. Because the bottom magnetic core is exposed to the oxygen plasma during etching, the surface of the magnetic core 75 is oxidized. To remove the oxide film, the exposed areas of the bottom magnetic cores are etched in a 2% hydrofluoric acid solution for 30 seconds. The vias 81 are then filled with a material having a relative magnetic permeability exceeding unity, such as, nickel-iron permalloy, using the electroplating bath and conditions described above. Upon completion of the via electroplating, the top magnetic cores are processed on the same level using the same process used for the conductor plating using a thick positive photoresist mold. FIG. 5*e* shows the device after the top magnetic cores 86 have been electroplated. Upon completion of the top core electroplating, the photoresist and electroplating seed layer are removed. The final thickness of the device relative to the substrate is approximately 90 μm in accordance with the preferred method discussed above.

Figure 6A:
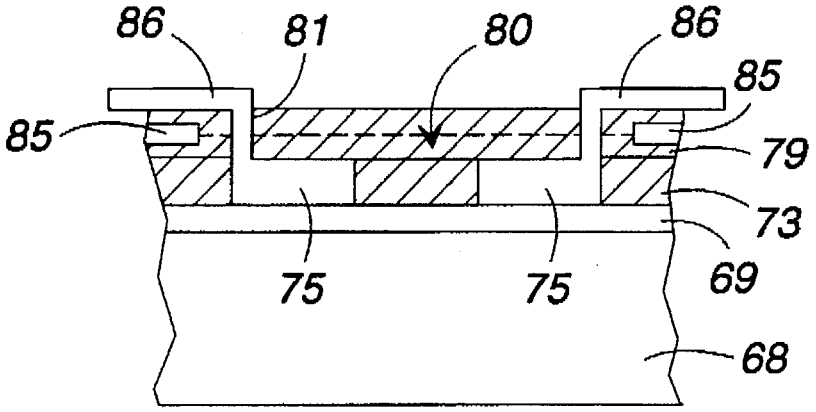
FIG. 6*a* illustrates an enlarged cross-sectional view of a portion of the device shown in FIG. 5*e*.
Figure 6B:
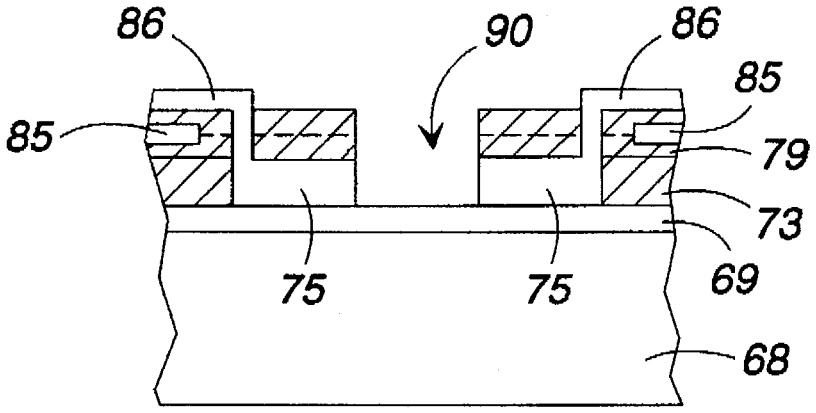
FIG. 6*b* illustrates the device shown in FIG. 6*a* wherein the fluid channel has been etched into the device.

As shown in FIG. 6*a*, an opening is left in the device (i.e., no vias or top magnetic core) for creating the fluid flow channel between the innermost lower magnetic cores. As shown in FIG. 6*b*, once the inductive components have been fabricated on the silicon wafer 68, the polyimide layers 73, 79 and 80 are etched using the above-described via etch process to form the fluid flow channel 90 and bonding pads (shown in FIG. 1). In order to remove the copper/chrome layer (not shown) located on the bottom of the channel, the structure is dry etched to the bottom to achieve a channel depth of 90 μm and the copper/chrome layer is then selectively wet etched. The bright titanium layer 69, which can serve as a mirror to verify or monitor the separation process is thereby exposed on the bottom of the channel. The channel preferably has a width of 100 μm.

Since the meander-type integrated inductor of the present invention is analogous in structure to the conventional solenoid bar-type inductor, an analysis of the meander-type integrated inductor of the present invention can be made by using already well-developed analysis for the conventional solenoid-bar type conductor. In order to show this analogy, it is necessary first to determine the total linkage flux of the meander-type integrated inductor of the present invention from which the simulated inductance as a function of permeability can be determined.

Figure 7:
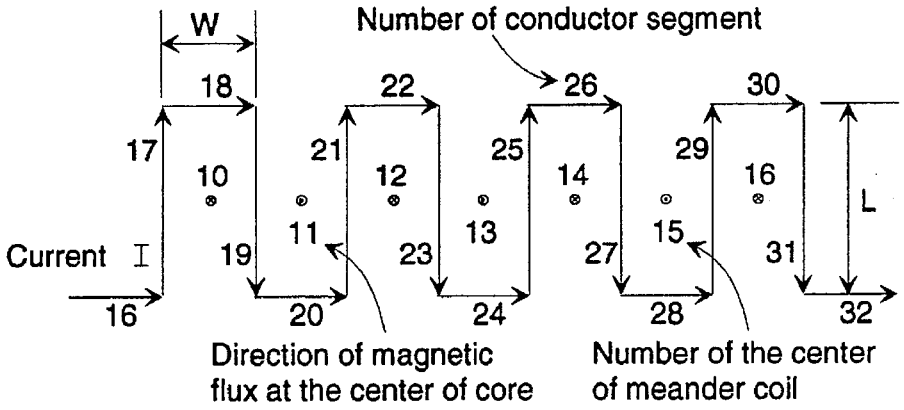
FIG. 7 illustrates a model of the meander conductor showing the direction of current through the conductor and the direction of the resulting magnetic flux.

The meander inductor geometry is composed of meander-type conductor lines located on a simple plane and meander magnetic cores located on the multilevels as shown in FIG. 4*a*. Since multilevel meander magnetic cores are interlaced through the center of each meander coil of the meander conductor, the magnetic flux density at the center of each meander coil can be calculated by evaluating magnetic fields at the center points, which are generated from the current flowing through all meander conductor elements, as shown in FIG. 7.

Figure 8:
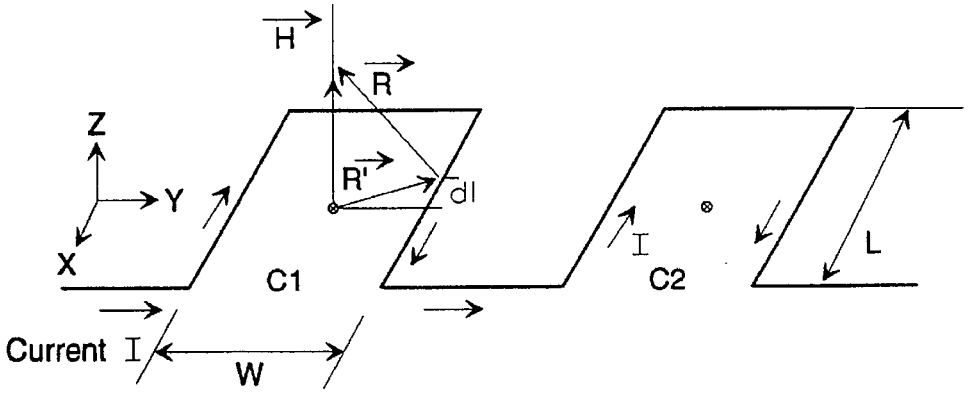
FIG. 8 illustrates the coordinate and meander elements for the Biot-Savart law calculation.

Consider two neighboring meander coils C1 and C2 carrying current I shown in FIG. 8. The self-inductance of meander coil C1 is defined as the magnetic flux linkage per unit current in the coil itself; that is, $$L_{11}=\Lambda_{11}/I, \qquad \text{Equation (2)}$$

where $\Lambda_{11}$ is the flux generated by C1 which links C1.

The mutual inductance between two meander conductor coils C1 and C2 is then the magnetic flux linkage with one circuit per unit current in the other, i.e., $$L_{12}=\Lambda_{12}/I, \qquad \text{Equation (3)}$$

where $\Lambda_{12}$ is the flux generated by C1 which links C2.

By expanding this topology to all distributed meander conductor elements as shown in FIG. 7, the inductance can be calculated from the total flux linkage (both self and mutual flux linkage) as:

$$L=\Sigma\Lambda/I, \qquad \text{Equation (4)}$$

where $\Sigma\Lambda$ denotes the total flux linkage, which happens between the closed multilevel meander magnetic circuit and the flux generated from the current flowing through all meander conductor elements. Note that this relation assumes that the material used to construct the conductor remains magnetically linear.

Figure 9:
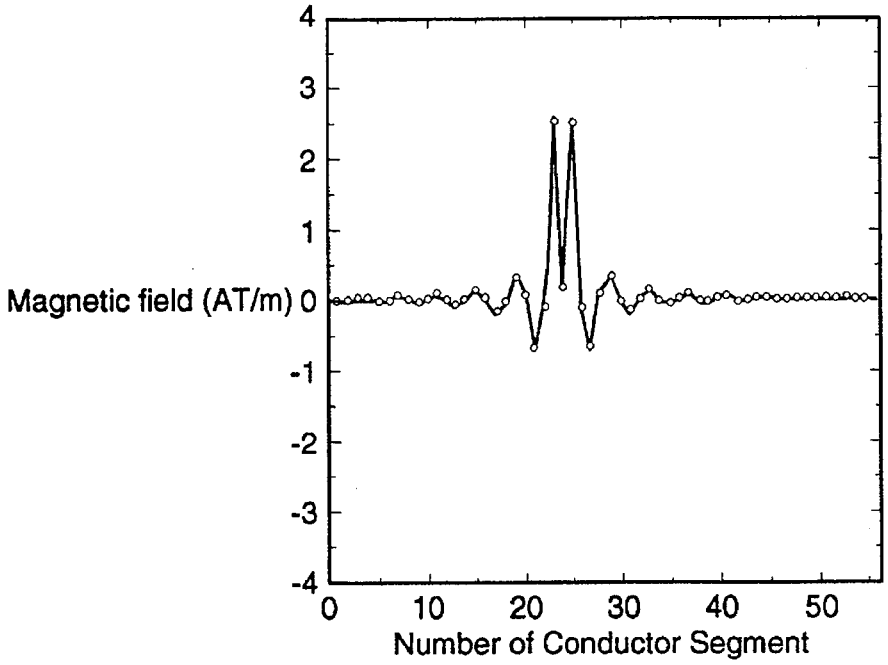
FIG. 9 illustrates the distribution of the magnetic field with respect to the center of meander coil number 13 shown in FIG. 7, which was generated by flowing 1 mA of current through the conductors.
Figure 10:
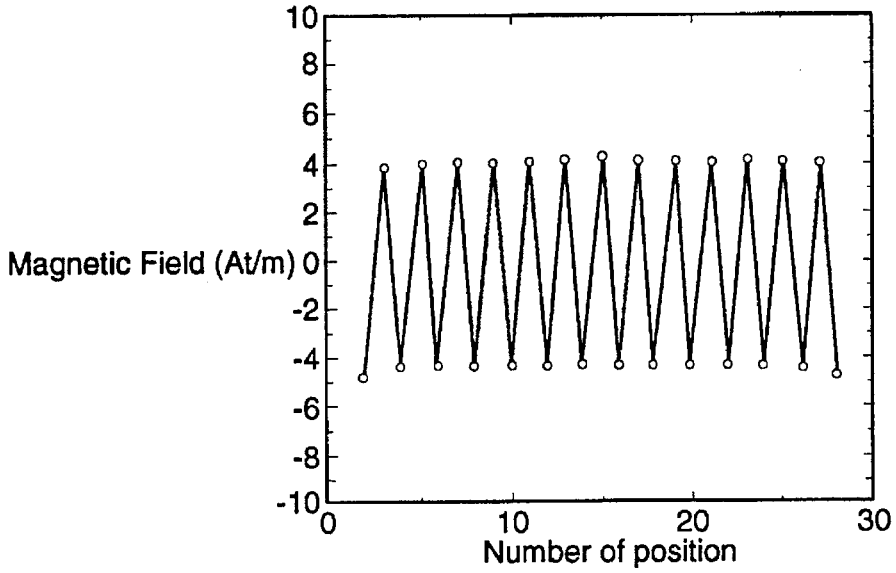
FIG. 10 illustrates the magnetic field distributions at the center of each meander coil with an assumed current of 1 mA flowing through the conductors.
Figure 11:
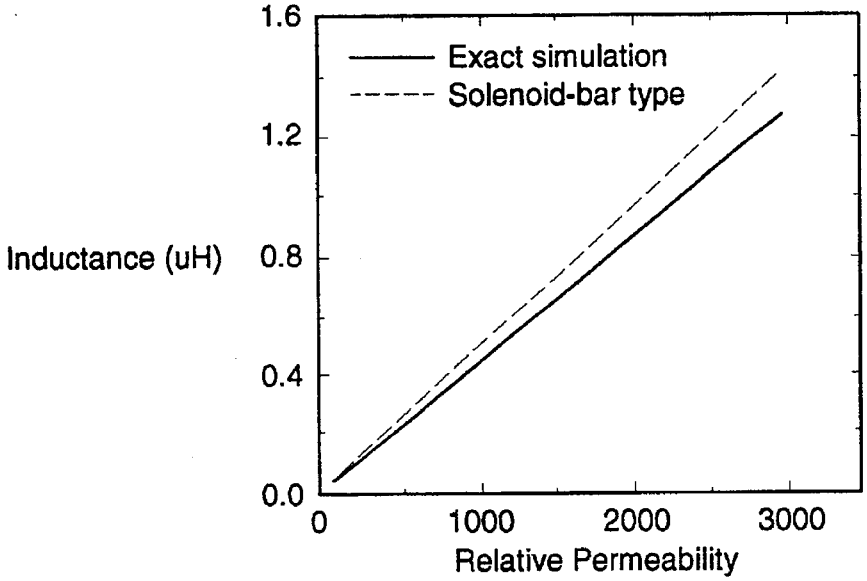
FIG. 11 provides a comparison between the meander-type inductor of the present invention and a conventional solenoid-bar type inductor.

To determine the magnetic field at the center of a meander coil due to the current I in the coil, Biot-Savart law can be invoked:

$$\vec{H}=\frac{I}{4\pi}\oint_{C}\frac{dl\times\hat{a}_R}{R^2} \qquad \text{Equation (5)}$$

and applied to the meander conductor elements shown in FIG. 8, where $\hat{a}_R$ is the unit vector directed from the source point to the field point. The magnetic field at the center of a meander coil element is equal to the vector summation of the magnetic fields that are induced at the center by all elements of the meander coil, satisfying the superposition principle. When a current of 1 mA flows through the meander conductor, FIG. 9 shows the distributed z-components of magnetic field that are generated by each meander conductor element with respect to the center point of #13 meander coil in FIG. 7. Since magnetic cores with relatively large permeability are located at these centers, the magnetic flux, $B=\mu_o\mu_r H$, will be concentrated mainly in these magnetic via cores. The z-components of the distributed magnetic flux at these centers are shown in FIG. 10. Although at the center of each meander coil, the vector direction of the z-component of the magnetic flux varies from point to point in the opposite direction, all fluxes of z-component in the magnetic circuit flow constructively through the multilevel meander core due to the core geometry. From the obtained total linkage flux and Equation (4), the simulated inductance as a function of relative permeability is plotted in FIG. 11, where W and L of the simulated meander element shown in FIG. 7 are 120 μm and 500 μm respectively. Since the ratio of the via magnetic reluctance to that of the flat core part is negligibly small (2.3%), the contribution of the via magnetic reluctance is neglected in this simulation.

The calculation of inductance for the solenoid-bar type structure depicted in FIG. 4*b* is very simple and more-or-less straightforward. The inductance L of the solenoid-bar type inductor structure (FIG. 4*b*) is expressed as:

$$L=\frac{\mu_o\mu_r N^2 A_c}{l_c} \qquad \text{Equation (6)}$$

where $A_c$ is the cross-sectional area of fill magnetic core, $l_c$ is the length of closed magnetic core, and $\mu_o$ and $\mu_r$ are the permeability of vacuum and the relative permeability of the magnetic core, respectively. To compare the inductance of the solenoid-bar type inductor structure calculated from Equation (6) with that of the meander-type inductor of the present invention, the analogous dimensions of the solenoid-bar type are chosen to have the same dimensions as the meander-type inductor: inductor size of 4 mm×1.0 mm; coil of 30 turns: $\mu_r$ of 500; and cross-sectional areas of magnetic core and conductor coil of 300 μm×12 μm and 50 μm×7 μm, respectively. A comparison of the inductance calculated from Equation (6) for an analogous solenoid-bar type structure and the "exact simulation" of the meander-type inductor described above is shown in FIG. 11. The simulation results for the solenoid-bar type and meander-type inductor are well matched, which ensures that the simple modeling technique used in the solenoid-bar type inductor is useful in analyzing the meander-type inductor.

The Q factor of an inductor can be expressed as:

$$Q=\frac{\omega L}{R}=\frac{\omega\mu_o\mu_r NA_cA_w}{2(W+L)pl_c} \quad \text{Equation (7)}$$

where $A_w$ is the cross section area of conductor, 2(W+L) is the length of one meander coil turn, and p is the resistivity of conductor material.

From Equations (6) and (7), it is concluded that inductance and Q factor are linearly proportional to $\mu_r$, in the meander type inductor as well as in the conventional solenoid-bar type inductor due to the analogous structure in both inductors. Eddy current losses in the magnetic core as well as skin depth effect in the conductor have been neglected in this calculation. This assumption should be justified since meander-type inductors fabricated using IC technology will have cores and conductors which have geometries on the order of microns.

An experiment has been conducted utilizing the fully integrated micromachined magnetic particle manipulator and separator fabricated in accordance with the process described above. The magnetic particles used in the experiment are commercially available superparamagnetic particles such as Estapor carboxylate-modified superparamagnetic particles, Bangs Laboratories, Inc. which are supplied as a aqueous dispersion with 60% solid content of magnetite. This magnetic particle consists of a ferrite crystal ($Fe_2O_3$, magnetite) with median diameters of 0.8 μm–1.3 μm. The magnetic particle density is 2.2 g/ml. The particles are surrounded by the usual polystyrene and carboxylic acid modified shell to isolate iron from the surface, so that they can be used for absorption as well as covalent attachment.

Separation tests can be performed either by flowing a suspension through the channel or by dipping the quadrupole of the separator into the suspension. The micromachined separator of the present invention just requires two simple steps to achieve the separation.

In this experiment, the magnetic fluid is placed in a syringe for handling convenience. To begin the experiment, several drops of fluid are applied to the reservoir resulting in fluid flow through the channel. With no current applied to the coils (i.e., without a magnetic field), no significant sedimentation or attachment of dispersed particles on the poles occurs even over a time span of several hours. An initial movement of magnetic particles is observed through a microscope when the DC current in the coils reaches 100 mA. To achieve a magnetic flux density of 0.03 Tesla at the air gap, it is estimated that the applied coil current should be at least 500 mA. When 0.8 V of DC voltage is applied to each inductor, resulting in a current flow of 500 mA, the particles move rapidly toward the quadrupole, separate from the buffer solution, and clump onto the poles. Upon removal of the current, the particles are immediately redispersed or removed from the poles without clumping.

As discussed above, two different combinations of electromagnet quadrupoles can be produced by changing the polarities of the DC excitation in the coils. The effect of the magnetic polarity on the separation was qualitatively assessed by applying 500 mA of DC current to each inductor for 10 seconds for both magnetic polarities. It was qualitatively observed that the magnetic particles are attracted more strongly from the N-N-S-S pole combination than the N-S-N-S combination, which may be due to a stronger magnetic field gradient attained from the N-N-S-S pole combination because of differing magnetic flux paths.

The inductance of an inductor usually varies as the reluctance of the magnetic path is varied. As particles are clumped on the poles, the reluctance in the air gap between poles will vary, resulting in a change in the inductance of the drive component. If this inductance variation as a function of separation time and current can be detected, the mount of separated particles may be approximately evaluated from the inductor geometry and the magnetic properties of the particles.

In summary, a fully integrated micromachined magnetic particle manipulator and separator which can be used to influence magnetic particles suspended in liquid solutions has been realized on a silicon wafer. A meander-type integrated inductor with fully integrated and insulated coils is used as a basic component of the device for the manipulator electromagnet. One potential application of the present invention is magnetic particle separation from solution. When 500 mA of current with a drive voltage of less than volt is applied to each inductor, very fast particle separation is observed. The magnetic particles clumped on the surface of electromagnet poles can be released and resuspended easily by removing the applied current. This separator can be repeatedly used for different separations after washing using acetone-based and methanol-based cleaning steps. The present invention further illustrates the high potential of integrated micromagnetics in chemical and biological application where the manipulation of small amounts of reagent are important.

Although the present invention has been discussed with respect to the preferred and alternative embodiments, it will be apparent to those skilled in the art that the present invention is not limited to these embodiments. For example, the process steps described above may be varied to alter certain characteristics of the magnetic particle manipulator and separator. It may also be desirable to use materials other than those described above to fabricate the magnetic particle manipulator and separator of the present invention. Therefore, a person of ordinary skill in the art will understand that variations and modifications of the present invention are within the spirit and scope of the present invention.

What is claimed:

1. An integrated magnetic particle manipulator and separator comprising:

a fluid flow channel having at least a bottom and two sides, said fluid flow channel comprising means for receiving a fluid having magnetic particles suspended therein, said fluid flow channel defining a pathway through said magnetic particle manipulator and separator whereby fluid received by said means for receiving fluid is allowed to flow through the fluid flow channel; and at least one integrated inductive component located on each side of the fluid flow channel, each inductive component comprised of a magnetic core and a conductor, each conductor having a first end and a second end, wherein the first and second ends are disposed to allow a voltage to be supplied to the inductive components, wherein each magnetic core has a portion thereof disposed adjacent the fluid flow channel, and wherein when a voltage is supplied to each of the conductors, current flows through the conductors thereby causing the portions of said magnetic cores disposed adjacent the fluid flow channel to produce opposite magnetic poles whereby the magnetic particles suspended in the fluid are caused to clump to the magnetic poles they are attracted to, thereby separating the magnetic particles in accordance with the polarity of the magnetic particles, wherein said fluid flow channel and said integrated inductive components are fully, integrally fabricated using a fabrication technique which includes lithography.

2. An integrated magnetic particle manipulator and separator according to claim 1 wherein there are two inductive components located on each side of the fluid flow channel and wherein each magnetic core of each inductive component has a first end and a second end wherein the first ends of said magnetic cores are disposed adjacent the fluid flow channel on opposite sides thereof such that the first ends of the magnetic cores located on one side of the fluid flow channel are opposite the first ends of the magnetic cores located on the other side of the fluid flow channel and wherein the ends of the magnetic cores disposed adjacent the fluid flow channel form a magnetic quadrupole and wherein two combinations of quadrupoles can be produced by switching the polarity of the voltage supplied to the conductors.

3. An integrated magnetic particle manipulator and separator according to claim 1 wherein each of said inductive components is a meander-type inductive component.

4. An integrated magnetic particle manipulator and separator according to claim 1 wherein said magnetic particle manipulator and separator is integrated on a silicon wafer.

5. An integrated magnetic particle manipulator and separator according to claim 1 wherein said conductors are comprised of copper.

6. An integrated magnetic particle manipulator and separator according to claim 1 wherein said conductors are comprised of aluminum.

7. An integrated magnetic particle manipulator and separator according to claim 1 wherein said magnetic cores are comprised of a material with relative magnetic permeability exceeding unity.

8. An integrated magnetic particle manipulator and separator according to claim 7 wherein said magnetic cores are comprised of Ni(81%)-Fe(19%) permalloy.

9. An integrated magnetic particle manipulator and separator according to claim 1 wherein said fluid flow channel is approximately 100 μm in width and approximately 90 μm in depth.

10. An integrated magnetic particle manipulator and separator according to claim 2 wherein each of said inductive components is a meander-type inductive component.

11. An integrated magnetic particle manipulator and separator according to claim 2 wherein said magnetic particle manipulator and separator is integrated on a silicon wafer.

12. An integrated magnetic particle manipulator and separator according to claim 2 wherein said conductors are comprised of copper.

13. An integrated magnetic particle manipulator and separator according to claim 2 wherein said conductors are comprised of aluminum.

14. An integrated magnetic particle manipulator and separator according to claim 2 wherein said magnetic cores are comprised of a material with relative magnetic permeability exceeding unity.

15. An integrated magnetic particle manipulator and separator according to claim 14 wherein said magnetic cores are comprised of Ni(81%)-Fe(19%) permalloy.

16. An integrated magnetic particle manipulator and separator according to claim 1 wherein the voltage supplied to the conductors to cause the magnetic particles to clump to said magnetic poles is less than 1 volt at 500 mA and wherein when the current is removed the magnetic particles dumped on said poles are released from said poles.

17. An integrated magnetic particle manipulator and separator according to claim 2 wherein the voltage supplied to the conductors to cause the magnetic particles to clump to the magnetic poles is less than 1 volt at 500 mA and wherein when the current is removed the magnetic particles dumped on said poles are released from said poles.

18. An integrated magnetic particle manipulator and separator according to claim 1 wherein said inductive components generate a magnetic flux and a magnetic field gradient.

* * * * *